US010443243B1

(12) United States Patent
Szafranski

(10) Patent No.: US 10,443,243 B1
(45) Date of Patent: Oct. 15, 2019

(54) GUTTER COVER

(71) Applicant: David A Szafranski, Avon, OH (US)

(72) Inventor: David A Szafranski, Avon, OH (US)

( * ) Notice: Subject to any disclaimer, the term of this patent is extended or adjusted under 35 U.S.C. 154(b) by 79 days.

(21) Appl. No.: 14/170,570

(22) Filed: Feb. 1, 2014

Related U.S. Application Data

(63) Continuation-in-part of application No. 13/506,829, filed on May 18, 2012, now abandoned.

(51) Int. Cl.
*E04D 13/076* (2006.01)
*E04B 1/70* (2006.01)

(52) U.S. Cl.
CPC ..... *E04D 13/076* (2013.01); *E04B 1/70* (2013.01)

(58) Field of Classification Search
CPC ..... E04D 13/076; E04D 13/0725
USPC ..... 52/11–16; 210/155, 163–166; 454/365
See application file for complete search history.

(56) References Cited

U.S. PATENT DOCUMENTS 1,597,503 A * 8/1926 Andrews ..... 52/12
2,209,741 A * 7/1940 Sullivan ..... E04D 13/076 210/474
3,295,264 A * 1/1967 Olson ..... 52/12
3,367,070 A * 2/1968 Mitchell ..... 52/12
4,592,174 A * 6/1986 Hileman ..... E04D 13/076 210/474
4,841,686 A * 6/1989 Rees ..... E04D 13/076 210/474
5,271,192 A * 12/1993 Nothum, Sr. ..... E04D 13/076 248/48.2
5,406,754 A * 4/1995 Cosby ..... 52/12
5,588,261 A * 12/1996 MacConochie ..... E04D 13/064 52/11
5,595,027 A * 1/1997 Vail ..... E04D 13/076 52/11
6,134,843 A * 10/2000 Tregear ..... E04D 13/076 210/474
6,226,926 B1 * 5/2001 Aritake ..... B60J 10/27 296/146.9
6,349,506 B1 * 2/2002 Pace ..... E04D 13/076 52/11
6,932,911 B1 * 8/2005 Groth ..... E04D 13/076 210/162
7,624,541 B2 * 12/2009 Gentry ..... 52/12
7,627,991 B1 * 12/2009 Feldhaus ..... E04D 13/076 210/155
7,740,755 B2 * 6/2010 Wilson ..... E04D 13/076 210/162

(Continued)

*Primary Examiner* — Kyle J. Walraed-Sullivan
(74) *Attorney, Agent, or Firm* — Jerry Semer

(57) ABSTRACT

The gutter cover is placed on top of the gutter and protects the gutter from leaves and debris flowing into the gutter while allowing water to pass into the gutter. The material used to make the gutter cover is a loosely woven fiber mesh that is approximately ¼ inch in thickness with a width slightly larger than the opening of a gutter. The material allows water to pass easily but will not allow debris and leaves to pass. The material is placed on top of the gutter and deflects leaves and debris over the gutter. As stated above the material's width is slightly larger than the width of the gutter. The installer bends the material and places it on top of the gutter between the fascia board and the lip of the gutter. The material forms a convex surface over the top of the gutter.

7 Claims, 2 Drawing Sheets

(56) References Cited

U.S. PATENT DOCUMENTS 8,402,697 B1* 3/2013 Ealer, Sr. ..... E04D 13/076 52/12
9,181,706 B1* 11/2015 Livers ..... E04D 13/076
2001/0037610 A1* 11/2001 Davis ..... 52/12
2004/0006927 A1* 1/2004 Wickett ..... 52/12
2004/0182015 A1* 9/2004 Roe et al. ..... 52/16
2005/0034376 A1* 2/2005 Pourdeyhimi ..... E04D 13/076 52/11
2005/0247611 A1* 11/2005 Groth ..... E04D 13/076 210/162
2006/0117672 A1* 6/2006 Kurple ..... E04D 13/076 52/12
2006/0201068 A1* 9/2006 Shane ..... E04D 13/064 52/11
2007/0277446 A1* 12/2007 Dowling ..... E04D 13/076 52/11
2008/0134587 A1* 6/2008 Ealer ..... E04D 13/076 52/12
2008/0163561 A1* 7/2008 Lenney et al. ..... 52/12
2009/0249704 A1* 10/2009 Wilson ..... E04D 13/076 52/12
2011/0056145 A1* 3/2011 Lenney et al. ..... 52/12
2011/0067318 A1* 3/2011 Lenney et al. ..... 52/12
2011/0126477 A1* 6/2011 Hurn ..... E04D 13/076 52/12
2011/0138698 A1* 6/2011 Neumann ..... E04D 13/076 52/12
2012/0047818 A1* 3/2012 Lopez ..... E04D 13/076 52/12
2012/0073212 A1* 3/2012 Wootton ..... 52/12
2012/0151849 A1* 6/2012 Brochu ..... E04D 3/364 52/12
2012/0192502 A1* 8/2012 Glander ..... E04D 13/076 52/12
2012/0222366 A1* 9/2012 Steinberg ..... E04D 13/076 52/12
2013/0145699 A1* 6/2013 Olthoff ..... E04D 13/076 52/12
2013/0160377 A1* 6/2013 Sager ..... E04D 13/076 52/12
2014/0215929 A1* 8/2014 Lenney ..... E04D 13/076 52/12
2014/0223837 A1* 8/2014 Pavlansky ..... E04D 13/076 52/12

* cited by examiner

GUTTER COVER

This application is a continuation in part of prior application Ser. No. 13/506,829 filed May 18, 2012.

FIELD OF THE INVENTION

This invention relates to an apparatus for preventing leaves and other debris from entering a rain gutter attached to the edge of a roof, and more particularly to a loosely woven fiber mesh that fits over the top of the rain gutter and prevents leaves and other debris from entering the rain gutter but allows rain to enter.

BACKGROUND OF THE INVENTION

There is a major problem with roofs. When it rains the water from a large area runs off the side of the roof. This causes the soil next to the home to erode and leads to moisture and water in the basement. To eliminate this problem gutters were invented. The gutter takes the water away from the roof and places it down the drain into a sewage system. This however creates another problem. Not only does the rainwater get in the gutters but also all kinds of debris and leaves. The debris and leave collects at a rate sufficient to clog the gutter and necessitates the cleaning of the gutter. The cleaning of the gutter is a time consuming and arduous job. It also involves climbing a ladder and is many times dangerous.

Numerous systems have been designed to solve this problem. These systems usually consist of a screen, a porous foam or a plate with openings placed over the gutter. The inventor began exploring these systems. The inventor found that most of the systems are very expensive and that there are problems with maintenance such as wasp forming nest in the gutter. The systems designed for the homeowner to instill are very complicated to install. Many of the system must be screwed in place and thus take a large amounts of labor to place within the gutters. Others have complicated interlocking systems to lock up on the gutter. They all take numerous hours of work attaching them to the gutter. Most of these systems are expensive to make, difficult to place on the gutters, and difficult to maintain.

One system shown in U.S. Pat. No. 5,956,904 to Gentry shows a system that uses two layers of metal screens to cover the gutter. One screen must be fold over the other at the edges. This makes for a high manufacturing cost. In addition, since the screens are metal they cannot be easily cut to fit different sizes of gutters.

One day when the inventor was fixing his roof, he noticed the material used for the roof vent. This material keeps the leaves out and allows air and water to flow through it. It is design to withstand all types of weather. The inventor went to the hardware store and purchased some of the material. This material is a loosely woven fiber mesh that is very porous however is also smooth on its surface. The woven mesh allows water to flow through with little impedance; however, its openings are far too small for a leaves and debris to be caught. The surface is somewhat smooth to larger objects and thus leaves and debris easily flow over its surface. He found that he could cut the material with just a utility knife. The material is easy to install. To install one cuts the material to the proper length and width, and places the material within the gutter. The material is elastically deform by the installer applying hand pressure to the material and compressing the edges of the material towards one another. The installer than places the material within the gutter and allows it to decompress against the gutter between the fascia board and the lip of the gutter. The material forms a convex surface over the top of the gutter. The installer can install the material in gutter of a whole home in a short time with only one tool, a utility knife to cut the material.

The inventor further tests the new material by placing the material in his gutters. The material stayed in place even in high wind and heavy downpours. The material also stayed in place during the heavy snows and ice of winter and returned to its original shape in spring.

Thus, the objective of this invention is to create a system that effectively keeps debris and leaves out of the average home gutter but is also inexpensive to make, easy to install and even easier to maintain.

To achieve these goal applicant has found a material that not only allows water and rain to flow easily through but also causes leaves and debris to easily wash over. This is an important advantage over other systems that have openings to allow the water flow through. Leaves and other debris get stuck in the openings and these systems must be cleaned. The openings in appellant's mesh are so small that very little debris or leaves are caught. However, they are of sufficient size to allow the water to easily flow.

As stated above, the surface is also somewhat smooth which enhances the ability of the debris and the leaves to wash over the loosely woven fiber mesh. Finally, if over the years there is some buildup of leaves or debris within the mesh the mesh is easily removed from the gutter, cleaned with the hose, and replaced with a little or no labor.

Another important feature of the material is that the material has sufficient stiffness that when it is deflected it will return to its original shape. The material can be easily placed within the gutter. The material is slightly deflected and placed between the fascia board and the lip of the gutter. The tension caused by the deflection will hold the material in place at the top of the gutter. The material has sufficient resistance to deflection to hold it in place even under high winds and heavy downpours. The material is easy to cut and thus easy to manufacture in the proper width. The material is easy to manufacture and inexpensive.

Applicant system takes no tools and only requires the slight deflection to be placed upon the gutter.

SUMMARY OF THE INVENTION

The article of manufacture is placed within a gutter and protects the gutter from leaves and debris from flowing into the gutter while allowing water to pass into the gutter and into the sewage system. The article manufacture is a loosely woven fiber mesh that is approximately ¼ inch in thickness with a width slightly larger than the opening of a gutter. The material comes in long rolls. The material allows water to pass through easily but will not allow debris and leaves to pass through. The material is placed on top of the gutter and deflects leaves and debris over the gutter. To place the material on the gutter one cuts the proper length of the material from the roll and places the length of material on top of the gutter. As stated above the material's width is slightly larger than the width of the gutter. The installer then bends the material and places it on top of the gutter between the fascia board and the lip of the gutter. The material forms a convex surface over the top of the gutter.

DETAILED DESCRIPTION OF THE INVENTION

Figure 1:
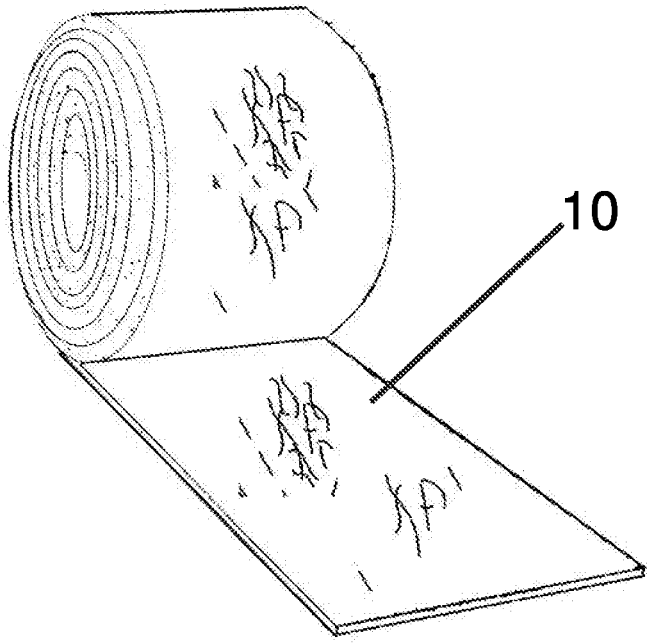
FIG. 1 is a perspective view of the material.

FIG. 1 shows the material 10 that is placed within the gutter 12. The material 10 is about a quarter inch thick and comes in long narrow rolls. The material 10 is a loosely woven fiber mesh that is presently on the market. The material 10 is made out of a loosely woven mesh made out of propylene ethylene copolymer that sold as Cobra® exhaust vent for roof ridge. Water and rain can easily flow through the material 10. However, the material 10 will not allow debris, leaves and other solids to flow through it. The material 10 limits the growth of harmful mold. The material 10 has sufficient stiffness that upon deflection will return to its original shape. In the preferred embodiment, the material 10 is slightly wider than the width of the gutter 12.

Figure 2:
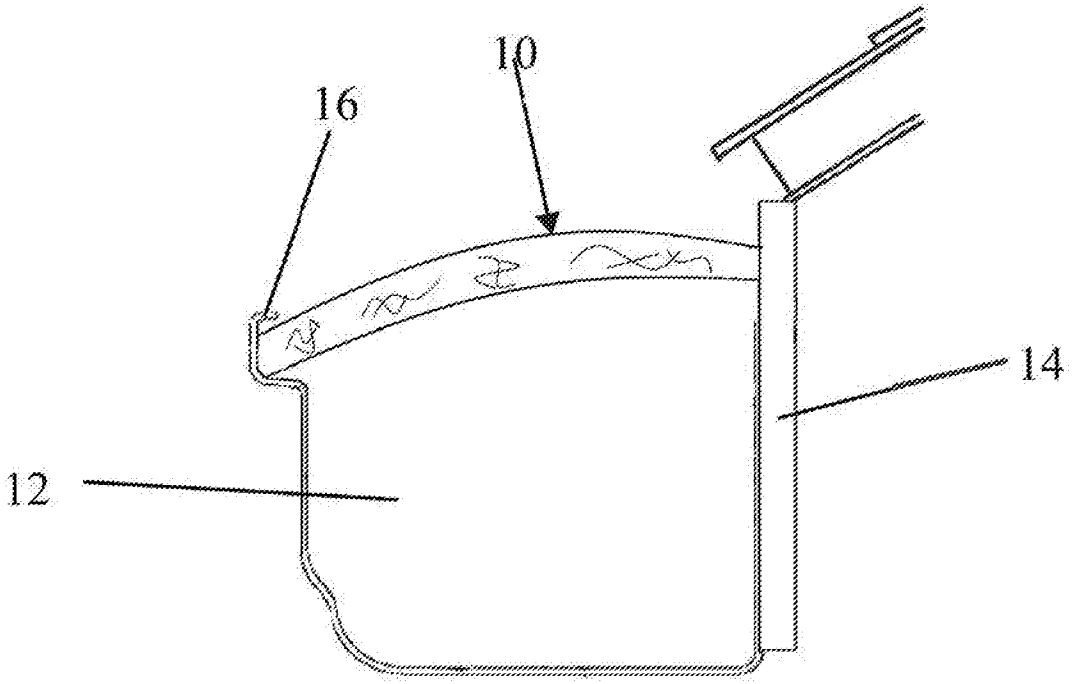
FIG. 2 is a cutaway view of the invention within a gutter upon a home.

The material 10 is placed in the gutter 12 as shown in FIG. 2. The material 10 fits over the top of the gutter 12 between the fascia board 14 and the lip 16 of the gutter 12. Since the material 10 is wider than the width of the gutter 12, to place the material 10 on top of the gutter 12, an individual bends the material and places it in between the fascia board 14 and the lip 16 of the gutter 12. The tension causes the material 10 to spring back to its original shape and holds the material 10 in place on top of the gutter 12. The material 10 forms a convex surface over the top of the gutter 12. The material 10 has sufficient resilience that it will withstand large gust of wind. Snow and ice in the winter will weigh down the material 10, however when the snow and ice melts the material 10 springs back into original position. The material 10 can easily be removed from the gutter 12 if desired by just bending the material and lifting it out of the gutter 12.

Changes and modifications in the specifically described in the embodiments can be carried out without departing from the scope of this invention, which is intended to be limited only by the scope of the appending claims.

I claim:

1. A gutter cover that prevents leaves and debris from entering a gutter with an open top and the gutter has a width, has a lip with a back and attaches to a fascia board on a house, consisting of:

a. a single layer fiber mesh, shaped in an initial flat plane with a width with a first and second edge, that is permeable to water and air but with openings that will not allow debris and leaves to flow through; and, b. said width of the single layer fiber mesh shaped in an initial flat plane is wider than the width of the open top of the gutter; and, c. the single layer fiber mesh is installed over the open top of the gutter, by positioning the first edge against the back of the lip of the gutter and positioning the second edge against the fascia board forming an arc over the open top of the gutter, and friction and stiffness holds the single layer fiber mesh in the arc with no other support or attachment means, making contact only with the back of the lip of the gutter and the fascia board.

2. A gutter cover that prevents leaves and debris from entering a gutter with an open top and the gutter has a width, has a lip with a back and attaches to fascia board on a house as in claim 1 wherein:

a. the single layer fiber mesh is made of propylene ethylene copolymer.

3. A gutter cover that prevents leaves and debris from entering a gutter with an open top and the gutter has a width, has a lip with a back and attaches to a fascia board on a house, as in claim 1 wherein:

a. the single layer fiber mesh is approximately a quarter of an inch thick.

4. A method for making a gutter cover that prevents leaves and debris from entering a gutter with an open top and the gutter has a width, has a lip with a back and attaches to a fascia board on a house consisting of the steps of:

a. obtaining a piece of single layer fiber mesh shaped in an initial flat plane, with a first and second edge and, that is permeable to water but with openings that will not allow debris and leaves to flow through; and, b. cutting the width of the piece of single layer fiber mesh shaped in an initial flat plane to a size that is larger than the width of the gutter; and, c. cutting the length single layer fiber mesh shaped in an initial flat plane to cover the gutter; and, d. placing the piece of single layer fiber mesh on top of the gutter; and, e. elastically deforming the piece of single layer fiber mesh; and, g. releasing the piece of single layer fiber mesh so that the single layer fiber mesh first edge makes contact with the back of the lip of the gutter and the single layer fiber mesh second edge make contact with the fascia board and friction and stiffness holds the single layer fiber mesh in an arc with no other support or attachment means, making contact only with the back of the lip of the gutter and the fascia board.

5. A method for making a gutter cover that prevents leaves and debris from entering a gutter with an open top and the gutter has a width, has a lip with a back and attaches to a fascia board on a house, as in claim 4 wherein:

a. the single layer fiber mesh is cut with a utility knife.

6. A method for making a gutter cover that prevents leaves and debris from entering a gutter with an open top and the gutter has a width, has a lip with a back and attaches to a fascia board on a house, as in claim 4 wherein:

a. the single layer fiber mesh is made of propylene ethylene copolymer.

7. A method for making a gutter cover that prevents leaves and debris from entering a gutter with an open top and the gutter has a width, has a lip with a back and attaches to a fascia board on a house, as in claim 4 wherein:

a. the single layer fiber mesh is approximately a quarter of an inch thick.

* * * * *